US006065404A

United States Patent [19]

Ripingill, Jr. et al.

[11] Patent Number: 6,065,404

[45] Date of Patent: May 23, 2000

[54] TRAINING GRENADE FOR MULTIPLE INTEGRATED LASER ENGAGEMENT SYSTEM

[75] Inventors: Allen E. Ripingill, Jr., San Diego; Larry W. Lind, La Mesa, both of Calif.

[73] Assignee: Cubic Defense Systems, Inc., San Diego, Calif.

[21] Appl. No.: 09/018,675

[22] Filed: Feb. 4, 1998

[51] Int. Cl.[7] ..... F42B 8/12

[52] U.S. Cl. ..... 102/498; 102/355; 102/482; 102/502; 102/513

[58] Field of Search ..... 102/355, 395, 102/482, 498, 502, 513, 529; 434/11

[56] References Cited

U.S. PATENT DOCUMENTS

| | | | |
|---|---|---|---|
| 2,108,818 | 2/1938 | Huff et al. | 102/395 |
| 3,596,078 | 7/1971 | Owens | 102/482 |
| 4,684,137 | 8/1987 | Armer, Jr. et al. | 102/513 |
| 4,932,329 | 6/1990 | Logie | 102/498 |
| 5,222,798 | 6/1993 | Adams | 102/355 |
| 5,246,372 | 9/1993 | Campagnulo et al. | 434/11 |
| 5,351,623 | 10/1994 | Kissel et al. | 102/498 |
| 5,410,815 | 5/1995 | Parikh | 33/234 |
| 5,426,295 | 6/1995 | Parikh | 250/227.1 |
| 5,474,452 | 12/1995 | Campagnuolo | 434/11 |
| 5,476,385 | 12/1995 | Parikh | 434/22 |
| 5,481,979 | 1/1996 | Walder | 102/498 |

FOREIGN PATENT DOCUMENTS

| | | | |
|---|---|---|---|
| 404155197 | 5/1992 | Japan | 102/498 |
| WO 94/08200 | 4/1994 | WIPO | 102/498 |
| WO 94/17358 | 8/1994 | WIPO | 434/11 |

OTHER PUBLICATIONS

MFA SIM 93 Training Hand Grenade, Janes Infantry Weapons, 1996, p. 521.

*Primary Examiner*—Harold J. Tudor
*Attorney, Agent, or Firm*—Michael H. Jester

[57] ABSTRACT

A re-usable simulated grenade is provided that may be utilized by soldiers training with a multiple integrated laser engagement system (MILES). The simulated grenade includes a central core having a blast chamber that contains a non-lethal quantity of an explosive detonated by a manually actuatable detonator mechanism. The core has a plurality of omni-directional passages containing a filer which is ejected to simulate the blast pattern of an actual grenade. A plurality of transducers such as infrared LED's, acoustic transducers or RF transducers are located on the core for emitting signals detectable by a plurality of sensors worn by a player within a predetermined proximity of the simulated grenade. A circuit including a pressure sensitive switch is located in the core and is connected to the transducers for energizing the same when the explosive is detonated. A player identification code (PID) is encoded onto the signals emitted by the transducers. Signal intensity levels are varied in a timed sequence upon detonation to create kill and near miss (wounded) zones. After creating the kill and near miss zones, the circuit causes the transducers to emit an intermittent pulse to thereby facilitate location and recovery of the training grenade for recharging with explosive and filler and subsequent re-use.

20 Claims, 7 Drawing Sheets

TRAINING GRENADE FOR MULTIPLE INTEGRATED LASER ENGAGEMENT SYSTEM

BACKGROUND OF THE INVENTION

The present invention relates to equipment utilized in military or para-military training, and more particularly, to simulated grenades used by soldiers in battlefield training exercises.

For many years the armed services of the United States of America have trained soldiers with a multiple integrated laser engagement system (MILES). A laser small arms transmitter (SAT) is affixed to each rifle carried by the infantry. The soldier pulls the trigger of his or her rifle to energize a laser in the SAT whose beam is aligned with the boresight of the rifle. At the same time a blank cartridge is ignited to simulate the firing of an actual round. See for example U.S. Pat. No. 5,476,385 of Parikh et al. entitled LASER SMALL ARMS TRANSMITTER granted Dec. 19, 1995 and assigned to Cubic Defense Systems, Inc. Each soldier wears a helmet and a vest or harness with optical sensors that are connected to circuitry for detecting and registering a laser hit. The soldier is immediately given a visual and/or audible signal to notify of the soldier of his or her casualty status. Player identification codes (PIDs) can be encoded on each laser beam so that the identity of the soldier making the "kill" and the weapon type can be ascertained. This is valuable in subsequent debriefing to explain to the soldiers the success or failure of various tactics and maneuvers. See for example U.S. Pat. No. 5,426,295 of Parikh et al. entitled MULTIPLE INTEGRATED LASER ENGAGEMENT SYSTEM EMPLOYING FIBER OPTIC DETECTION SIGNAL TRANSMISSION granted Jun. 20, 1995 and assigned to Cubic Defense Systems, Inc. The MILES system can also be configured to simulate indirect fire such as artillery and mortars, as well as minefields.

One weapon that is still widely used by infantry is the hand grenade. In the past, hand grenades for training purposes have been developed that simulate the flash and bang of an actual hand grenade, but lack the high explosive and fragmentation casing that would cause serious injury. Training grenades have also been developed that discharge smoke. Other training grenades have been developed that have a safe frangible outer shell that encloses a minimal explosive charge and a quantity of paint or dye which marks an enemy to indicate a casualty.

A non-explosive training grenade is commercially available for use in a MILES training exercise. This prior art MILES training grenade is handled and thrown in the same manner as an operational grenade. Once the pin is pulled and the training grenade is thrown, a battery powered electronic circuit activates an audible signal after a predetermined delay to indicate an explosion. At the same time the grenade emits infrared light from a plurality of light emitting diodes (LEDs) that emit radiation in a frequency range that is detectable by the optical sensors worn by soldiers within a predetermined simulated explosion radius, thus designating these soldiers as casualties in the training exercise. A PID may be encoded in this prior art MILES training grenade so that soldiers "killed" with such a grenade can determine who attacked them. The grenade is turned ON using a sender located on the soldier's optical detector harness. Ten minutes after its simulated detonation, this MILES training grenade emits a search code every minute to allow location, retrieval and reuse of the training grenade. This prior art MILES training grenade does not simulate the flash and bang of a real grenade, which greatly detracts from its realism and effectiveness in a simulated combat scenario. In addition, this prior art MILES training grenade cannot simulate an injury to a player, instead of a kill. Soldiers are sometimes injured, but not killed, by real grenades thrown in an actual battle.

SUMMARY OF THE INVENTION

It is therefore the primary object of the present invention to provide an improved MILES compatible training grenade.

In accordance with the present invention a simulated grenade comprises a core, a quantity of an explosive contained in the core for providing a non-lethal explosion upon detonation, and a manually actuatable detonator mounted on the core for detonating the explosive. At least one transducer is mounted on the core for emitting signals detectable by a plurality of sensors worn by a player within a predetermined proximity of the simulated grenade. A circuit located in the core is connected to the transducer for energizing the same when the explosive is detonated.

DESCRIPTION OF THE PREFERRED EMBODIMENTS

As used herein the term "player" refers to a soldier, vehicle, stationary structure or some other object in a simulated battlefield that is equipped with sensors for receiving signals from our training grenade and therefore suffering injury or damage. For example, where the player is a soldier, our training grenade can inflict a simulated "kill" or a simulated "injury", depending upon how close it is when it explodes. Where the player is a light vehicle, it may carry sensors to indicate that it has been rendered inoperable by simulated shrapnel where our training grenade detonates in or near the vehicle.

Figure 1:
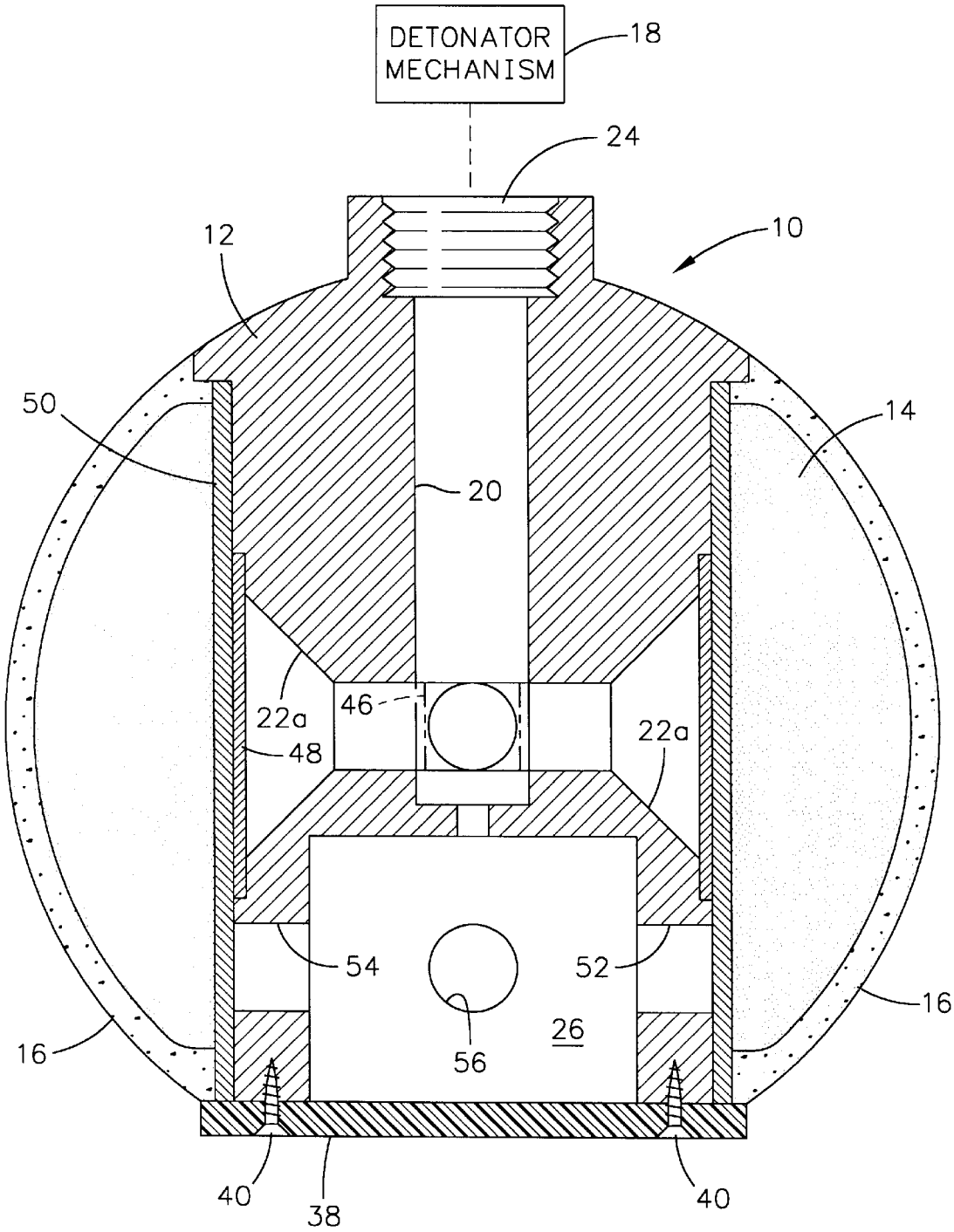
FIG. 1 is a vertical sectional view of a first embodiment of our training grenade.

Referring to FIG. 1, a first embodiment of our training grenade 10 comprises a generally cylindrical metal core 12 surrounded by a biodegradable filler 14 such as talcum powder and a generally spherical outer frangible casing or shell 16 made of paper mache or paper treated with a fire retardant agent. The training grenade 10 has the approximate weight, size and configuration of an actual lethal hand grenade such as an M67 delay fragmentation hand grenade utilized by the armed forces of the United States. For example, the outer diameter of the spherical casing 16 may be approximately sixty-three and one-half millimeters, the overall vertical height of the training grenade 10 may be approximately eighty-nine and seven-tenths millimeters. The weight of the training grenade 10 may be approximately three hundred ninety grams.

The training grenade 10 (FIG. 1) has a manually actuatable detonator mechanism, illustrated diagrammatically as box 18, similar to that utilized in the M67 grenade. The fuse portion of the detonator mechanism 18 is preferably a Model M228 fuse that is activated by a conventional striker which is held down by a safety lever. The safety lever is held down by a split pin which must be pulled out before throwing the grenade. The detonator 18 mechanism also includes a quantity of conventional primer compound and a quantity of a conventional detonator material.

Figure 2:
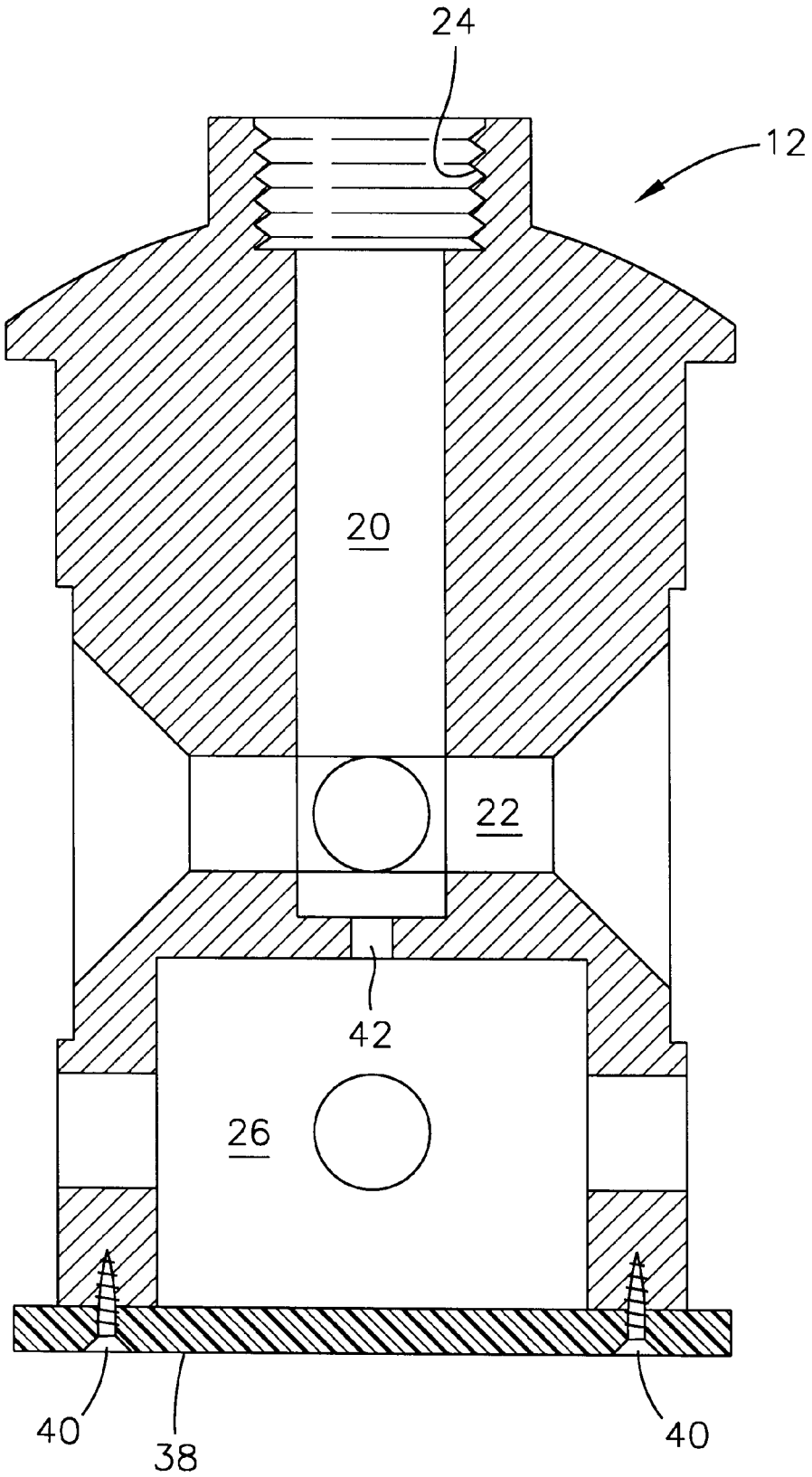
FIG. 2 is a vertical sectional view of the central core of the first embodiment of our training grenade.
Figure 7:
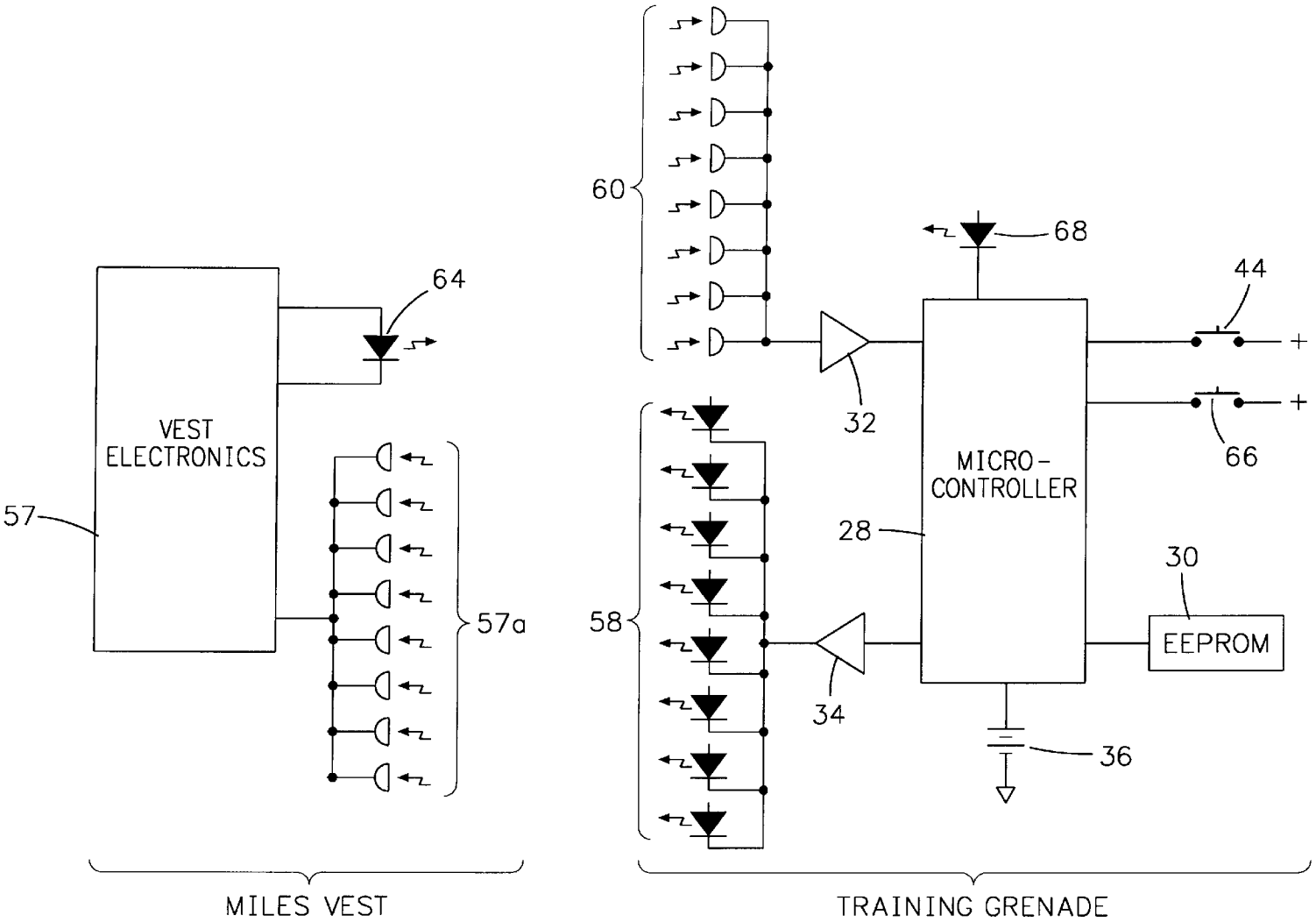
FIG. 7 is a schematic diagram illustrating the programming of a player identification code (PID) into the first embodiment of our training grenade with a player's vest.

The cylindrical core 12 (FIG. 2) is preferably machined, molded, or cast of metal, such as pot metal or Aluminum, to provide the various cavities and passages hereafter described. The core 12 has a vertically extending central cylindrical fuse receptacle 20 that communicates at its lower end with a pair of horizontally extending passages 22 that extend orthogonally through the core 12. The intersection of these two passages 22 defines a blast chamber. The upper end of the fuse receptacle 20 communicates with a female threaded bore 24 into which the detonator mechanism 18 is screwed after the fuse thereof has been inserted into the receptacle 20. The lower end of the fuse receptacle 20 communicates with a relatively large cylindrical electronics compartment 26 which is open at the lower end of the core 12. The electronics compartment 26 houses a circuit including a microcontroller 28 (FIG. 7), electrically erasable programmable read only memory (EEPROM) 30, detector amplifier 32, driver amplifier 34 and battery 36. The electronics compartment 26 (FIG. 2) is sealed by a flat cover panel 38 removably held to the core 12 via screws that fit through holes 40 in the panel 38 and thread into tapped holes in the core 12.

A small aperture 42 (FIG. 2) connects the blast chamber at the intersection of the passages 22 and the electronics compartment 26. A pressure sensitive switch 44 connected to the microcontroller 28 in the circuit is positioned adjacent the lower end of the aperture 42. A non-lethal quantity of an explosive preferably in the form of an explosive charge 46 (FIG. 1) is detonated by the fuse of the detonator mechanism. This actuates the pressure sensitive switch 44.

The passages 22 (FIG. 1) have flared or tapered outer portions defined by conical walls 22*a*. These outer portions 22*a* of the passages 22 are sealed by covers such as paper tapes 48 which are affixed to stepped shoulders machined into the exterior of the core 12. A supplemental cover in the form of a cardboard tube 50 slips over the outside of the core 12. These covers protect the internal components of the grenade 10 against damage due to mud and other extreme environmental conditions. When the explosive charge 46 is detonated, the paper tapes 48 and cardboard tube 50 are ruptured. The force of the explosion is directed outwardly from the conical outer portions 22*a* disperse the filler 14 and paper mache casing 16. The blast audibly and visibly simulates the flash and bang of an actual lethal hand grenade. A realistic dispersal pattern is facilitated by the combination of the cylindrical passages 22 and conical outer portions 22*a* which define series of tapered outwardly directed spokes.

Four holes, three of which 52, 54 and 56 receive transducers that are part of the circuit mounted inside the electronics compartment 26. These transducers emit signals detectable by a plurality of sensors such as optical detectors 57*a* (FIG. 7) on a MILES vest 57 worn by a player within a predetermined proximity of the training grenade 10 when it explodes. The transducers may comprise, for example, infrared LEDs 58 (FIG. 7) that emit radiation at a MILES compatible frequency, acoustic MOUT compatible transducers such as those commercially available from Polaroid Corporation, or radio frequency (RF) transducers. The microcontroller 28 (FIG. 7) energizes the transducers, which are the LEDs 58 in FIG. 7, when the explosive charge 46 is detonated to actuate the pressure sensitive switch 44. The core 12 preferably has additional holes (not illustrated) for receiving the other four LEDs 58. The LEDs are positioned ninety degrees apart around the circumference of the core 12 at two different heights on the core 12. This positioning allows the infrared radiation emitted by these LEDs to project more or less omni-directionally away from the training grenade 10. This offers the highest probability that a player, such as a solder wearing a vest and helmet with optical sensors, will be electronically "killed" if the training grenade lands within a predetermined proximity or range of the player.

Referring again to FIG. 7, the circuit of the first embodiment further includes a plurality of sensors such as optical detectors 60 whose outputs are fed through an amplifier 32 to the microcontroller 28. An emitter such as an LED 64 on the front chest portion of the MILES vest 57 may be activated by the soldier to emit signals encoded with his or her PID. The soldier then holds the training grenade 10 near the LED 64 and the detectors 60 on the training grenade 10 pick up the signals to encode the grenade with the PID. The microcontroller 28 encodes this PID onto the signals emitted by the infrared LEDs 58 upon detonation. In this fashion, a player affected by the grenade 10 will be able to determine, during subsequent debriefing for example, what soldier caused his or her simulated death or injury. A PID switch 66 in the training grenade's circuit is actuated by the soldier to place the circuit into a mode for receiving a PID from the player's vest. A red LED 68 in the circuit is energized once the PID has been acquired to provide a visual indication to the player that he or she has successfully programmed his or her PID into the training grenade 10.

When the training grenade 10 is detonated, the microcontroller 28 causes the infrared LEDs 58 to emit radiation at a first predetermined intensity level during a first interval, e.g. five seconds, to cause a player within a predetermined proximity to experience a simulated kill. The radiation emitted during the first interval may simulate a MILES "kill" code. Thereafter the microcontroller causes the LEDs 58 to emit radiation at a second higher predetermined intensity level during a second predetermined interval, e.g. fifteen seconds, after the first interval to cause a player within a predetermined proximity to experience a simulated non-lethal casualty. The radiation emitted during the second interval may simulate a MILES "Near Miss" code. Thereafter the microcontroller causes the LEDs 58 to emit a radiation pulse once per second, for example, at a third predetermined intensity level during a third predetermined interval, e.g. until the grenade is retrieved. The third interval represents a "Find Mode" of operation.

Figure 8:
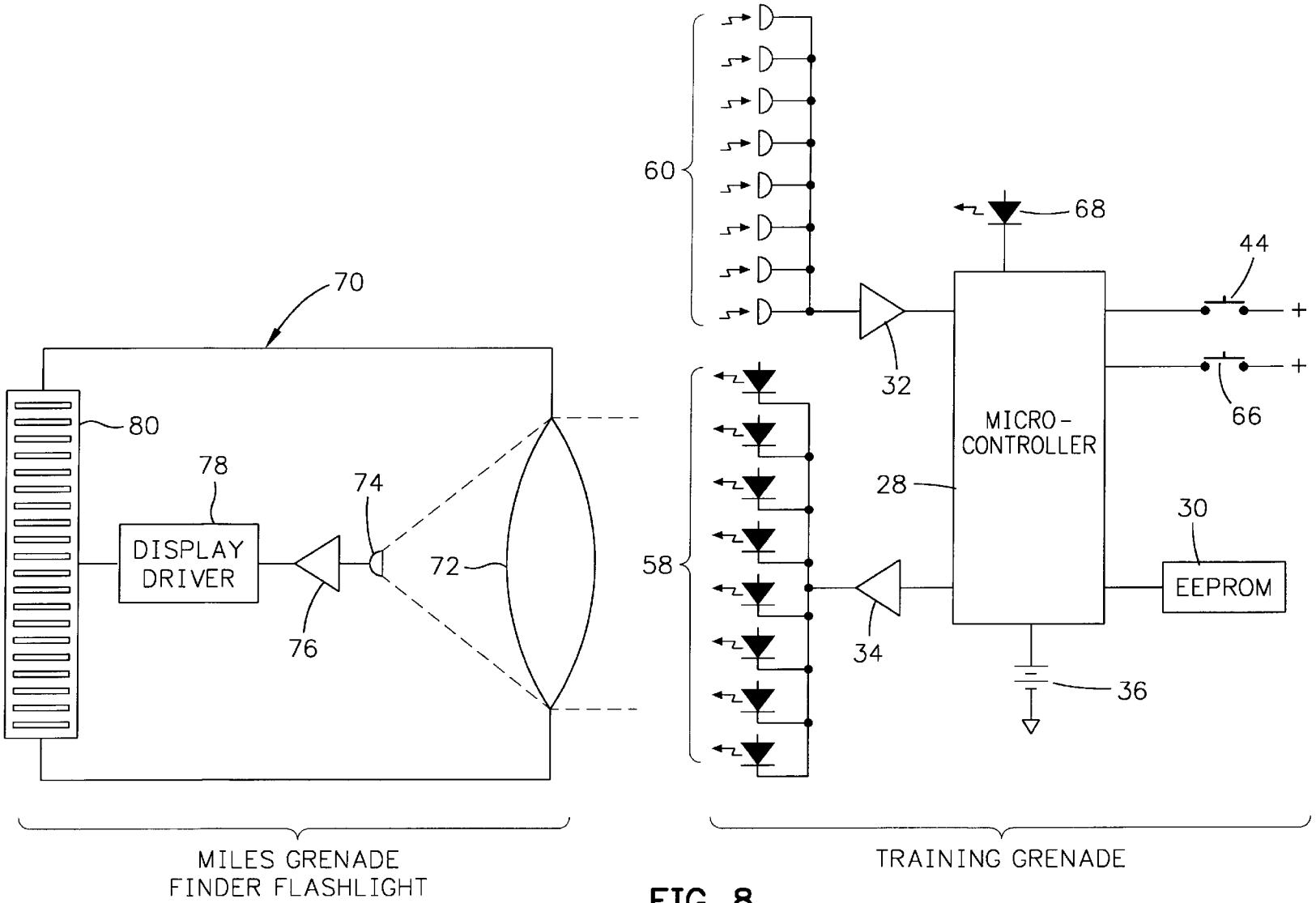
FIG. 8 is a schematic diagram illustrating the location of the first embodiment of our training grenade with a MILES flashlight.

FIG. 8 is a schematic diagram illustrating the location of the training grenade 10 with a MILES flashlight 70. The flashlight 70 receives radiation emitted by the LEDs 58 of the training grenade 10 during its Find Mode of operation. The radiation is focused by a lens 72 on a detector 74 whose signal is increased by an amplifier 76 that is fed to a display driver 78. The display driver 78 is connected to a bar graph display 80 whose individual bar elements are successively illuminated depending upon the strength of the radiation signal detected by the MILES flashlight 70. Thus a soldier on a recovery mission points the MILES flashlight 70 to determine the direction and proximity of the training grenade 10 and proceeds accordingly. The visual indications on the bar graph display 80 are used by the soldier to decide where to walk to locate the training grenade 10 based on the highest detected level of energy. The lens 72 is preferably designed to provide a large field of view. The detector 76 preferably has a maximum sensitivity to detect infrared radiation having a nine hundred and four nanometer wavelength emitted by the LEDs 58 of the training grenade 10.

Figure 3:
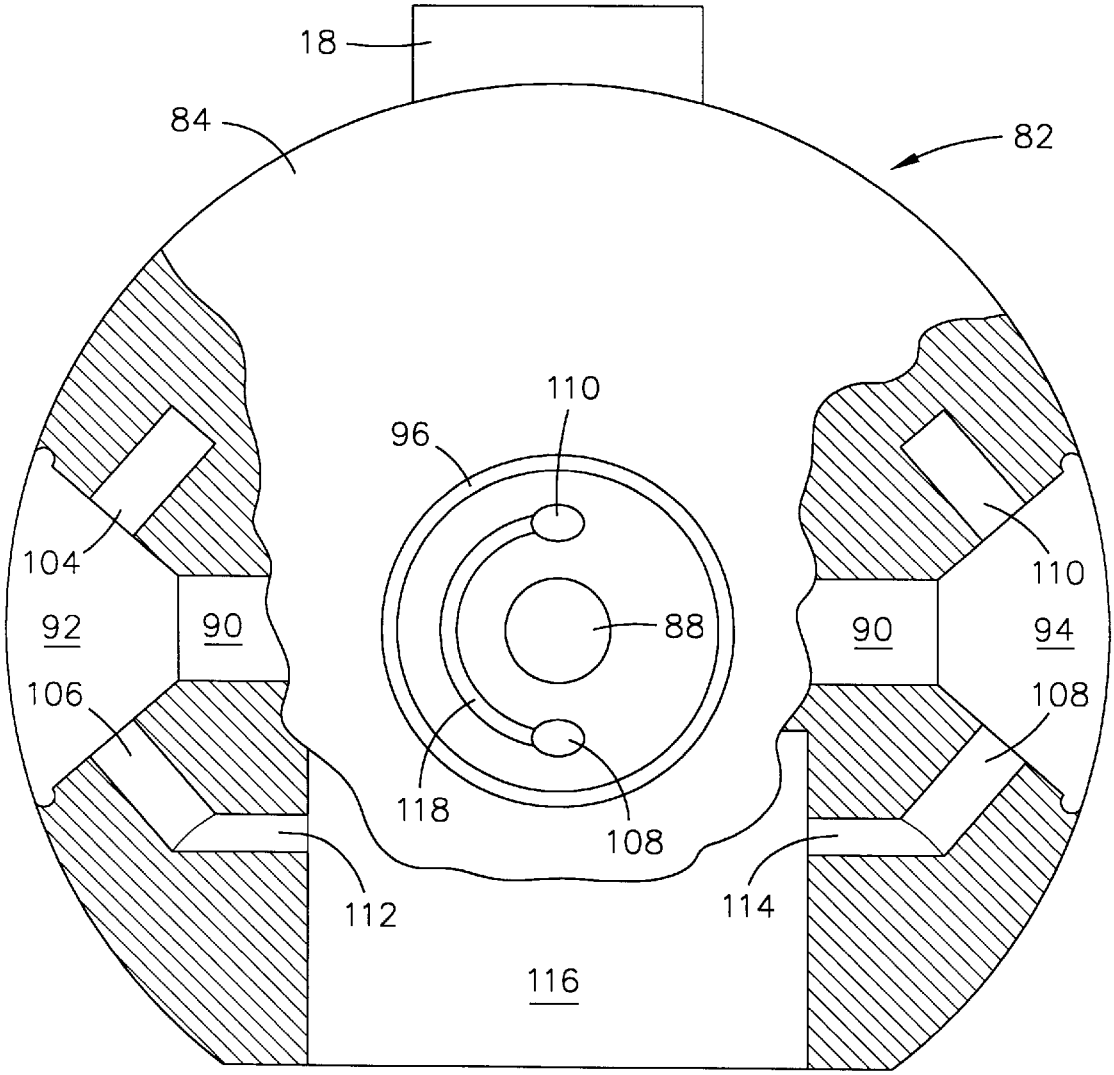
FIG. 3 is an elevational view of a second embodiment of our training grenade with portions broken away to illustrate details thereof.
Figure 4:
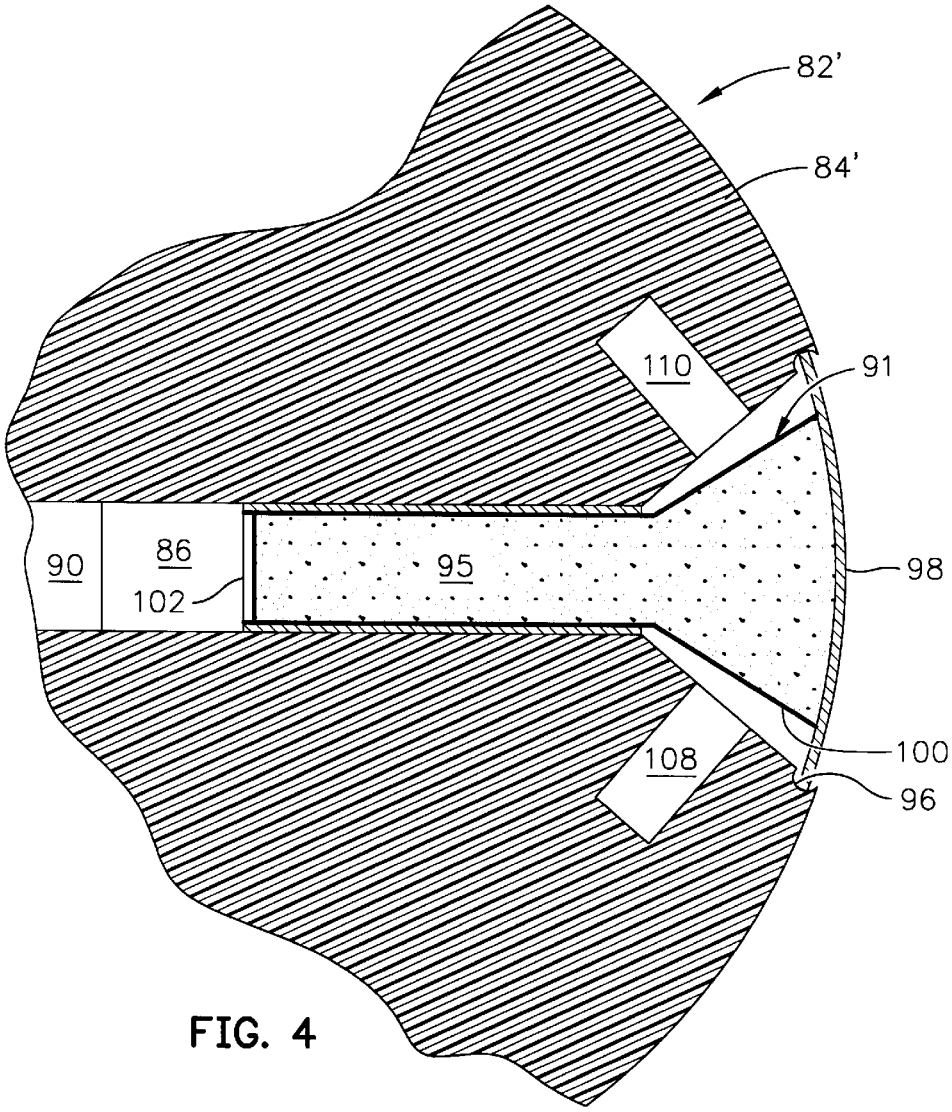
FIG. 4 is an enlarged sectional view illustrating a portion of a third embodiment of our training grenade.
Figure 5:
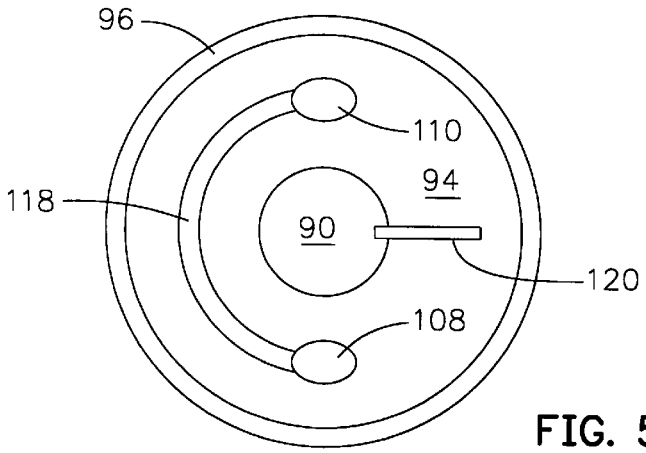
FIG. 5 is an elevation view illustrating a portion of the third embodiment of our training grenade.
Figure 6:
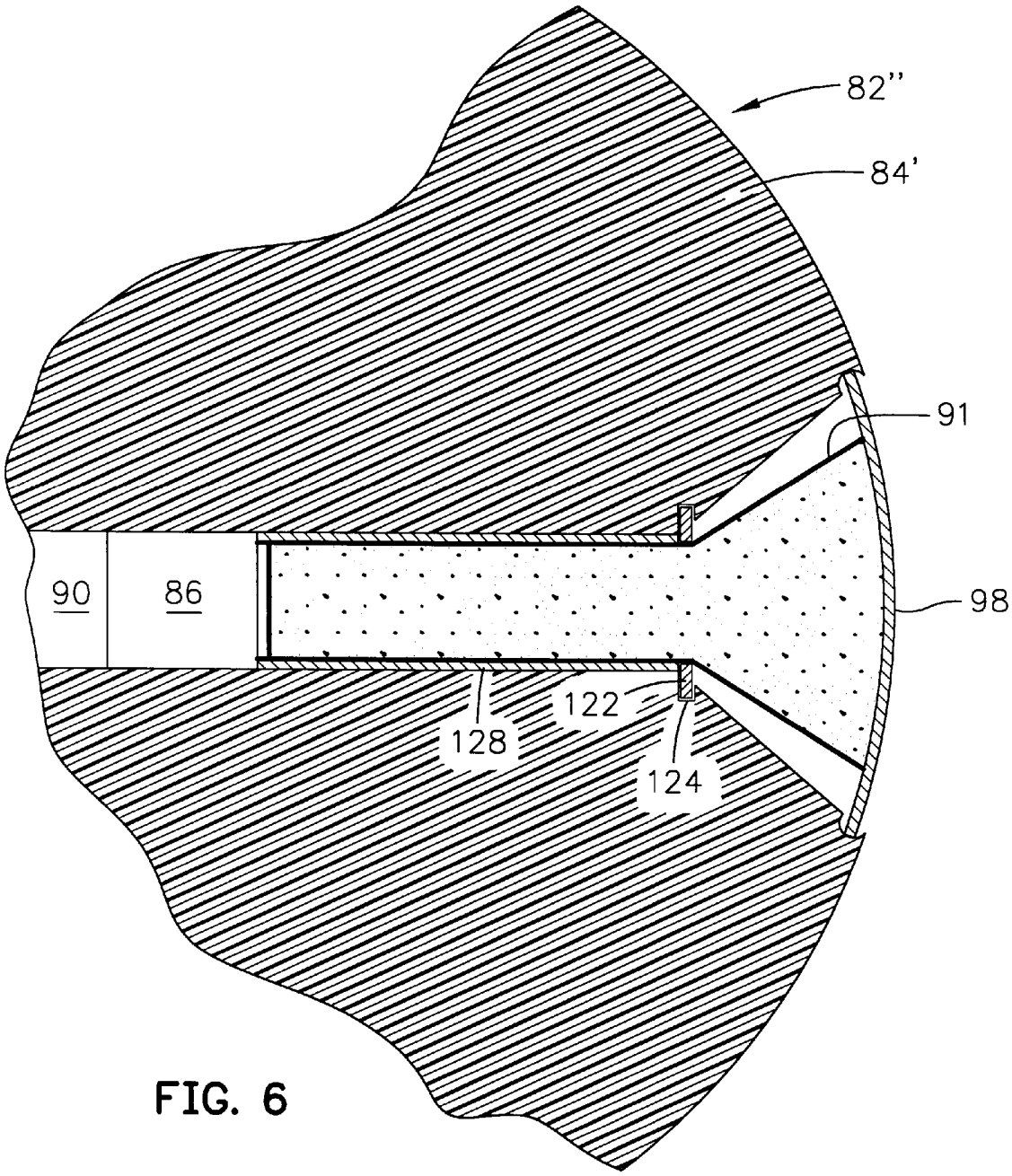
FIG. 6 is a view similar to FIG. 4 illustrating a fourth embodiment which employs snap rings.

FIG. 3 is an elevational view of a second embodiment 82 of our training grenade with portions broken away to illustrate details thereof. The training grenade 82 (FIG. 3) has a generally spherical metal core 84. FIGS. 4 and 6 illustrate a third embodiment 82' and a fourth embodiment 82", respectively, which are similar to the second embodiment except that the latter employ an elastomeric core 84'. Thus, in describing the second embodiment 82 of FIG. 3, reference is made periodically to FIGS. 4–6. All three embodiments 82, 82' and 82" have a central blast chamber 86 (FIG. 4) inside their cores. The metal core 82 (FIG. 3) is preferably made of Aluminum and its size and weight are selected so that the finished training grenade has the weight and feel of an actual lethal hand grenade. Two orthogonal bores 88 and 90 (FIG. 3) intersect the blast chamber 86 and each receive two confetti tubes such as 91 (FIG. 4), one in each end thereof. The metal core 84 is formed with four conical-shaped recesses such as 92 and 94 at the terminal ends of each of the bores. When the detonator mechanism shown schematically at 18 ignites the explosive charge (not illustrated) within the blast chamber 86 the confetti 95 (FIG. 4) inside the confetti tubes is blown outwardly so that the flash and bang of the simulated grenade 82 seems realistic to a nearby player.

The outer end of each of the conical-shaped recesses such as 92 and 94 in the core 84 is formed with a peripheral groove such as 96 (FIG. 4). A thin circular cardboard cover such as 98 has its edges seated in the peripheral groove of each of the conical-shaped recesses. Each confetti tube such as 91 preferably has a conical shaped outer portion defined by a conical plastic outer wall 100 and a thin disk-shaped plastic inner wall 102. When the explosive charge is detonated, the plastic inner wall 100 forces all of the confetti outward blowing off the cardboard cover 98. The confetti tubes are cheaper to manufacture than the paper mache outer skin 16 (FIG. 1) of the first embodiment 10. The second embodiment 82 is also easier to re-load since an explosive pellet can be inserted into the chamber 86 and then four confetti tubes loaded.

Referring again to FIG. 3, the conical shaped recesses such as 92 and 94 of the metal core 84 are each formed with a pair of outwardly opening cylindrical recesses for mounting LEDs such as 104, 106, 108 and 110. The cardboard covers such as 98 protect these LEDs from mud, etc. The angle and spacing of the LEDs in the second embodiment 82 are selected so that the radiation they emit will simulate the explosion pattern of an actual lethal hand grenade. Holes such as 112 and 114 are machined into the metal core 84 so that the lower LED of each pair of LEDs mounted in the same conical recess such as 92 can be connected via wires (not illustrated) to the electronic circuit (not illustrated) inside an electronics chamber 116 formed at the lower end of the metal core 84. A semi-circular groove 118 (FIG. 5) is machined or cast into the wall of each of the conical shaped recesses so that wires (not illustrated) can be inserted therein to connect the lower and upper LEDs such as 108 and 110 mounted in each recess. A barb 120 may be mounted in another machined or cast groove (not illustrated) for locking an adjacent confetti tube such as 91 in position within its corresponding bore such as 90.

FIG. 6 illustrates a fourth embodiment 82". It employs snap rings such as 122 that seat in annular grooves such as 124 formed in the core 84' to engage detents or slots (not visible) in the sides of the confetti tubes 128. The core 84' is made of a hard elastomer such as synthetic rubber instead of metal.

Thus it will be appreciated that our invention also provides a method of simulating the throwing of a hand grenade in a battlefield training exercise. First, a device is provided with the approximate weight, size and configuration of an actual lethal hand grenade. The device is charged with a non-lethal quantity of an explosive. The device is then provided with a manually actuable time-delayed detonator. The device is provided with at least one transducer for emitting signals upon energization that are detectable by sensors worn by a player within a predetermined range of the device. The device is further provided with a circuit including a switch for detecting an explosion and energizing the transducer. Once the device has been assembled, the detonator is manually actuated by a player. The player then throws the grenade at a target. The time-delayed detonation of the explosive ejects the confetti and actuates the switch in the circuit to energize the transducer, thereby causing the transducer to emit the signals. Any players within the predetermined range will experience a simulated fatality or injury.

While we have described several embodiments of our training grenade, it will be apparent to those skilled in the art that our invention may be modified in both arrangement and detail. Therefore the protection afforded our invention should only be limited in accordance with the following claims.

We claim:

1. A simulated grenade, comprising:

a core;

a quantity of an explosive contained in the core for providing a non-lethal explosion upon detonation;

a manually actuatable detonator mechanism mounted to the core for detonating the explosive;

transducer means connected to the core for emitting signals detectable by a plurality of sensors worn by a player within a predetermined proximity; and circuit means mounted to the core and including a switch actuated by the force of the explosion created when the explosive is detonated, the circuit means being connected to the transducer means for energizing the same when the switch is actuated.

2. The simulated grenade of claim 1 wherein the transducer means emits radiation in a predetermined optical wavelength detectable by a plurality of optical sensors worn by a soldier.

3. The simulated grenade of claim 1 wherein the circuit includes a plurality of sensors for receiving signals from a remote source to program a PID into the simulated grenade.

4. The simulated grenade of claim 1 and further comprising a quantity of confetti loaded in at least one confetti tube formed inside the core adjacent the explosive in a position to be ejected upon detonation of the explosive.

5. The simulated grenade of claim 1 and further comprising a frangible shell surrounding at least a portion of the core and the explosive.

6. The simulated grenade of claim 2 wherein the radiation emitting means includes a plurality of infrared LEDs.

7. The simulated grenade of claim 2 wherein the circuit means causes the transducer means to emit radiation at a first predetermined intensity level during a first interval after detonation of the explosive to cause a player within a predetermined proximity to experience a simulated kill and at a second predetermined intensity level during a second predetermined interval after the first interval to cause a player within a predetermined proximity to experience a simulated non-lethal casualty.

8. The simulated grenade of claim 1 wherein the switch is mounted in the core and is pressure sensitive.

9. The simulated grenade of claim 7 wherein the circuit means causes the transducer means to intermittently emit radiation during a third predetermined interval after the second predetermined interval to allow the simulated grenade to be located.

10. The simulated grenade of claim 1 wherein the manually actuatable detonator mechanism includes a striker which is held down by a safety lever.

11. The simulated grenade of claim 1 wherein the core is generally cylindrical and includes a blast chamber for receiving the quantity of explosive and a plurality of radially extending passages leading from the blast chamber.

12. The simulated grenade of claim 11 wherein the core further includes a filler in the passages which is ejected into the air upon detonation of the explosive.

13. The simulated grenade of claim 11 wherein the core includes a frangible outer shell surrounding the core and made of paper treated with a fire retardant agent.

14. The simulated grenade of claim 1 wherein the transducer means emits acoustic signals.

15. The simulated grenade of claim 1 wherein the transducer means emits radio frequency signals.

16. The simulated grenade of claim 12 wherein the filler is made of a biodegradable material.

17. The simulated grenade of claim 11 wherein the passages extend in a plurality of different directions to channel the force of the detonation so that it simulates the blast pattern of an actual lethal grenade.

18. The simulated grenade of claim 1 wherein the circuit means is programmable so that a player identification code (PID) is transmitted via the signals.

19. The simulated grenade of claim 18 and further comprising a second plurality of sensors mounted on the core and connected to the circuit means for allowing the PID to be programmed into the grenade by at least one programming transducer worn by the player.

20. A method of simulating the throwing of a hand grenade in a battlefield training exercise, comprising the steps of:

providing a device with the approximate weight, size and configuration of an actual hand grenade;

charging the device with a non-lethal quantity of an explosive;

providing the device with a manually actuatable time-delayed detonator;

providing the device with at least one transducer for emitting a plurality of signals upon energization that are detectable by sensors worn by a player within a predetermined range of the device;

providing the device with a circuit including a switch for detecting an explosion of the explosive which is activated the detonator and energizing the transducer;

manually actuating the detonator; and throwing the grenade at a target;

whereby the detonation of the explosive will actuate the switch in the circuit to energize the transducer, thereby causing the transducer to emit the signals.

* * * * *

UNITED STATES PATENT AND TRADEMARK OFFICE

CERTIFICATE OF CORRECTION

PATENT NO. : 6,065,404

DATED : May 23, 2000

INVENTOR(S) : Allen E. Ripingill, Jr. & Larry W. Lind

It is certified that error appears in the above-identified patent and that said Letters Patent is hereby corrected as shown below:

Column 8, line 29, after "vated" insert - - by - - .

Signed and Sealed this

Twentieth Day of February, 2001

*Attest:*

Nicholas P. Godici

NICHOLAS P. GODICI

*Attesting Officer*

*Acting Director of the United States Patent and Trademark Office*